US010871160B2

(12) United States Patent
Santarossa

(10) Patent No.: US 10,871,160 B2
(45) Date of Patent: Dec. 22, 2020

(54) VOLUMETRIC LOBE COMPRESSOR FOR EQUIPMENT COLLECTING WASTE MATERIAL

(71) Applicant: Jurop S.P.A., Azzano Decimo (IT)

(72) Inventor: Danilo Santarossa, Azzano Decimo (IT)

(73) Assignee: JUROP S.P.A., Azzano Decimo (IT)

( * ) Notice: Subject to any disclaimer, the term of this patent is extended or adjusted under 35 U.S.C. 154(b) by 314 days.

(21) Appl. No.: 15/750,430

(22) PCT Filed: Aug. 8, 2016

(86) PCT No.: PCT/IB2016/054771
§ 371 (c)(1),
(2) Date: Feb. 5, 2018

(87) PCT Pub. No.: WO2017/021941
PCT Pub. Date: Feb. 9, 2017

(65) Prior Publication Data

US 2018/0230999 A1 Aug. 16, 2018

(30) Foreign Application Priority Data

Aug. 6, 2015 (IT) ..... 102015000042688

(51) Int. Cl.
*F04C 18/12* (2006.01)
*F04B 53/10* (2006.01)
(Continued)

(52) U.S. Cl.
CPC ..... *F04C 18/126* (2013.01); *F01C 21/108* (2013.01); *F04C 18/086* (2013.01);
(Continued)

(58) Field of Classification Search
CPC .. F02B 29/0406; F04C 29/0007; F04C 29/12; F04C 18/126; F04C 18/086;
(Continued)

(56) References Cited

U.S. PATENT DOCUMENTS 3,658,452 A * 4/1972 Kita ..... F04C 15/0042 418/203
2002/0051720 A1* 5/2002 Kasai ..... F04C 2/086 418/83
(Continued)

FOREIGN PATENT DOCUMENTS

| | | |
|---|---|---|
| EP | 1967735 | 10/2008 |
| FR | 2676255 | 11/1992 |
| WO | WO2015066479 | 5/2015 |

*Primary Examiner* — Deming Wan
(74) *Attorney, Agent, or Firm* — Stetina Brunda Garred and Brucker

(57) ABSTRACT

Volumetric compressor (1) for collection and/or treatment equipment of material in liquid, solid, dusty or muddy form. The compressor (1) comprises an operative chamber (50), defining a suction section and an exhaust section of a first fluid, a first header (61) and a second header (62), which delimit said chamber (50) on opposite parts along a longitudinal axis (101). The compressor further comprises at least two rotors (80', 80") with lobes (81', 81") housed in the chamber (50), each rotor (80', 80") rotating about a rotation axis (108', 108") substantially parallel to said longitudinal axis (101). The lobes of each rotor develop according to a helical profile. Furthermore, each of the headers (61,62) defines at least one injection opening (71', 71",72',72") communicating with a feeding device (150) of a second fluid.

20 Claims, 9 Drawing Sheets

(51) Int. Cl.

| | |
|---|---|
| ***F04C 18/16*** | (2006.01) |
| ***F04C 18/18*** | (2006.01) |
| ***F04C 29/00*** | (2006.01) |
| ***F04C 29/12*** | (2006.01) |
| ***F02B 29/04*** | (2006.01) |
| ***F01C 21/00*** | (2006.01) |
| ***F01C 21/10*** | (2006.01) |
| ***F04C 18/08*** | (2006.01) |

(52) U.S. Cl.
CPC ..... *F04C 29/0007* (2013.01); *F04C 29/0035* (2013.01); *F04C 29/12* (2013.01); *F04C 2240/20* (2013.01)

(58) Field of Classification Search
CPC .... F04C 29/0035; F04C 29/124; F04C 18/16; F04C 18/18; F01C 21/108; F01C 21/007; F04B 53/1092
See application file for complete search history.

(56) References Cited

U.S. PATENT DOCUMENTS

| | | | | |
|---|---|---|---|---|
| 2004/0194766 | A1 | 10/2004 | Prior et al. | |
| 2009/0142212 | A1 | 6/2009 | Huang | |
| 2009/0191083 | A1* | 7/2009 | Huang ..... | F04C 18/123 418/206.3 |

* cited by examiner

VOLUMETRIC LOBE COMPRESSOR FOR EQUIPMENT COLLECTING WASTE MATERIAL

CROSS REFERENCE TO RELATED APPLICATION(S)

The present application claims priority to PCT International Application No. PCT/IB2016/054771 filed on Aug. 8, 2016, which application claims priority to Italian Patent Application No. 102015000042688 filed Aug. 6, 2015, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to the scope of making of components intended to make suction equipment and/or suction systems for material in liquid, solid, dusty or muddy form etc. In particular, the invention relates to a volumetric lobe compressor which can be preferably, but not exclusively, installed on collection equipment, which may be, for example, a tanker vehicle.

PRIOR ART

In the scope of making equipment for cleaning and/or collecting and treating waste it is known to use suction/compression assemblies configured to achieve vacuum in a collection system, which may be, for example, a tank mounted on a truck and/or to compress air in the system itself. More specifically, the expression "suction/compression assembly" means the whole formed by an operative machine and by the components needed to couple it to any system for the purposes indicated above.

Most of the suction/compression assemblies envisage the use of an operative machine configured to transfer a gas mass from a suction section to an exhaust section of an operative chamber. More precisely, the operative machine has a "pressurized" operating mode and a "vacuum" operating mode". In the "pressurized" operating mode, the machine compresses the air from the suction section, at atmospheric pressure, to the exhaust section with a pressure variation typically between 1 and 1.5 Bar. In "vacuum" operating mode, the machine compresses the air from the suction section (under vacuum) to the exhaust section, typically at atmospheric pressure. The maximum vacuum may reach values in a range from 50 to 100 mBar absolute.

An operative machine intended for a suction/compression assembly as defined above is indicated in the sector also with the word "compressor". In most cases, a "compressor" comprises a pair of lobe rotors housed in the chamber defined by a body which develops along a longitudinal axis. The chamber is axially delimited by a first header and by a second header, which support the opposite ends of the rotors. One of the two headers contains a transmission, operated by an external motor and configured to rotate the two rotors in synchronous manner, but in disagreeing senses. The rotors typically have straight lobes, i.e. lobes which develop parallel to the rotation axis of the rotor itself.

FIGS. 1, 2 and 3 are diagrammatic views related to the operation of a compressor of known type. Hereinafter, reference is made to the "vacuum" operating mode, but considerations related to the FIGS. from 1 to 3 conceptually apply also to the "pressurized" operating mode. The gas processed in the chamber 2 is compressed not directly by the machine, but by the exhaust gas by flow-back at the exhaust section 4. Substantially, the gas in exhaust conditions (Pressure Ps and Temperature Ts) expands in the operative chamber 2 thus compressing the mass contained therein. FIG. 1 shows the upper rotor 10 and a counterclockwise rotation thereof. The synchronized motion of the rotors 10,20 creates, with the body 7 of the chamber 2, suction volumes (indicated by reference numeral 5) containing an air volume at suction pressure (Pb) and a suction temperature (Ta) characteristic of the suction section 3.

With reference to FIG. 2, by effect of the rotation of the upper rotor, the exhaust section 4 becomes communicating with the suction volume 5 in a given instant. By effect of the exhaust pressure (Ps), greater than the suction pressure (Pb), the exhaust gas expands in the chamber 2 thus compressing the suction air until ambient pressure (Pa) is reached, considering precisely a "vacuum" operating mode". With reference to FIG. 3, there are no thermodynamic transformations in the exhaust section 4, the working volume is canceled by the rolling motion of the rotor lobes and the working air mass, added to the flow-back air mass at constant pressure and temperature (Pa, Ts), is introduced into the exhaust pipe.

During the normal operation of a lobe compressor, the temperature (Ts) of the gas in the exhaust section 4 is higher than the temperature (Ta) in the suction section 3. Irreversibility and volumetric losses increase the real value of the exhaust temperature (Ts) with respect to an ideal value calculated assuming that the passage of the gas in the chamber occurs according to a reversible adiabatic transformation. In order to contain/lower the end of compression temperature, it is known to introduce gas into the chamber through openings obtained in the body of the compressor.

Diagrams from 4 to 6 are diagrammatic views of a volumetric compressor with gas injection on the body (also named "frontal injection") during the "vacuum" operating mode. The opening of the gap 8 defined through the body 7 puts the outside environment into communication with the chamber 2 before the opening of the exhaust gap. Compression is thus not performed by the exhaust gas at exhaust temperatures but by the injection gas at ambient temperatures. With reference to FIG. 4, also in the "vacuum" operating mode with air injection, during the step of suction, the synchronized motion of the rotors 10,20 delimits an air volume 5 at suction pressure (Pb) and at ambient temperature (Ta). With reference to FIG. 5, as soon as the air volume 5 is delimited, the movement of the corresponding rotor determines the opening of the injection gap 8, and thus the injection of air at ambient conditions (Pa, Ta). The latter air, having a higher pressure than that already in the volume 5, expands in the working chamber 2, thus compressing the air in the volume 5 until ambient pressure is reached. With reference to FIG. 6, when the rotor opens the exhaust, the step of injecting is concluded and the air mass, given by the sum of the suction air and of the injection air, is introduced at ambient pressure and a temperature Ts, which will be lower than that which can be reached in compressor without injection.

It has been seen that the greatest drawbacks of the traditional compressors is represented by the loud noise. This aspect is particularly critical when the compressors are intended to be used on moveable equipment in urban context (e.g. tanks for draining cesspools, sewers etc.). In the compressors of the type shown in FIGS. from 1 to 3, noise is generated at the exhaust section of the working chamber by effect of the pressure oscillations due to the expansion of the exhaust gas in the working chamber at the lowest pressure. Instead, in frontal injection compressors (FIGS. from 4 to 6), the noise mainly derives from the pulsations due to the oscillations of flow rate and sound waves which are generated in the injection pipes through which the injection gas reaches the working chamber. Such pulsations, generated either in the exhaust or in the injection pipes, negatively influence the durability of the mechanical components, and thus the reliability of the compressor.

Given the considerations indicated above, it is the main task of the present invention to provide a volumetric compressor which makes it possible to overcome the drawbacks of the prior art described above. In the scope of the present task, it is a first object of the present invention to provide a volumetric compressor which has lower noise than the known solutions. It is another object of the present invention to provide a volumetric compressor which makes it possible to contain and/or greatly reduce the pressure oscillations in the exhaust and/or the pulsations in the injection pipes. It is a not last object to provide a volumetric compressor which is compact, reliable and easy to make at extremely competitive costs.

SUMMARY OF THE INVENTION

The object of the present invention is a volumetric compressor for waste material collection and/or treatment equipment. The compressor according to the invention comprises an operative chamber which defines a longitudinal development axis. The chamber is defined by a main body which defines, in turn, a suction section and an exhaust section of a first gas. The compressor also comprises a first header and a second header connected on opposite sides of the main body. The two headers limit the operative chamber along the longitudinal axis from opposite sides. The compressor further comprises at least two lobe rotors housed in the chamber; each rotor rotating about a rotation axis substantially parallel to the longitudinal development axis of the chamber. The compressor further comprises a feeding device of a second fluid towards the operative chamber. The compressor according to the invention is characterized in that the lobes of the rotors develop according to a "helical" profile about the rotation axis of the corresponding rotor and in that each of the headers defines at least one opening communicating with the feeding device for injecting said second fluid into said operative chamber.

It has been seen that the shape of the lobes of the rotors combined with the injection of the second gas through the headers determines a major abatement of the noise and of the vibrations of the compressor with benefits in terms of durability of the mechanical components, and thus reliability of the compressor. This translates into greater versatility of use of the compressor.

The present invention also relates to equipment for the suction and/or treatment of material in liquid, solid, dusty or muddy form comprising said volumetric compressor.

BRIEF DESCRIPTION OF THE FIGURES

Further features and advantages of the present invention will be more apparent from the following detailed description provided by way of non-limitative example and illustrated in the accompanying figures, in which:

FIGS. from 1 to 3 are diagrammatic views related to the operation of a first compressor of known type;

Figures 1, 2, 3:
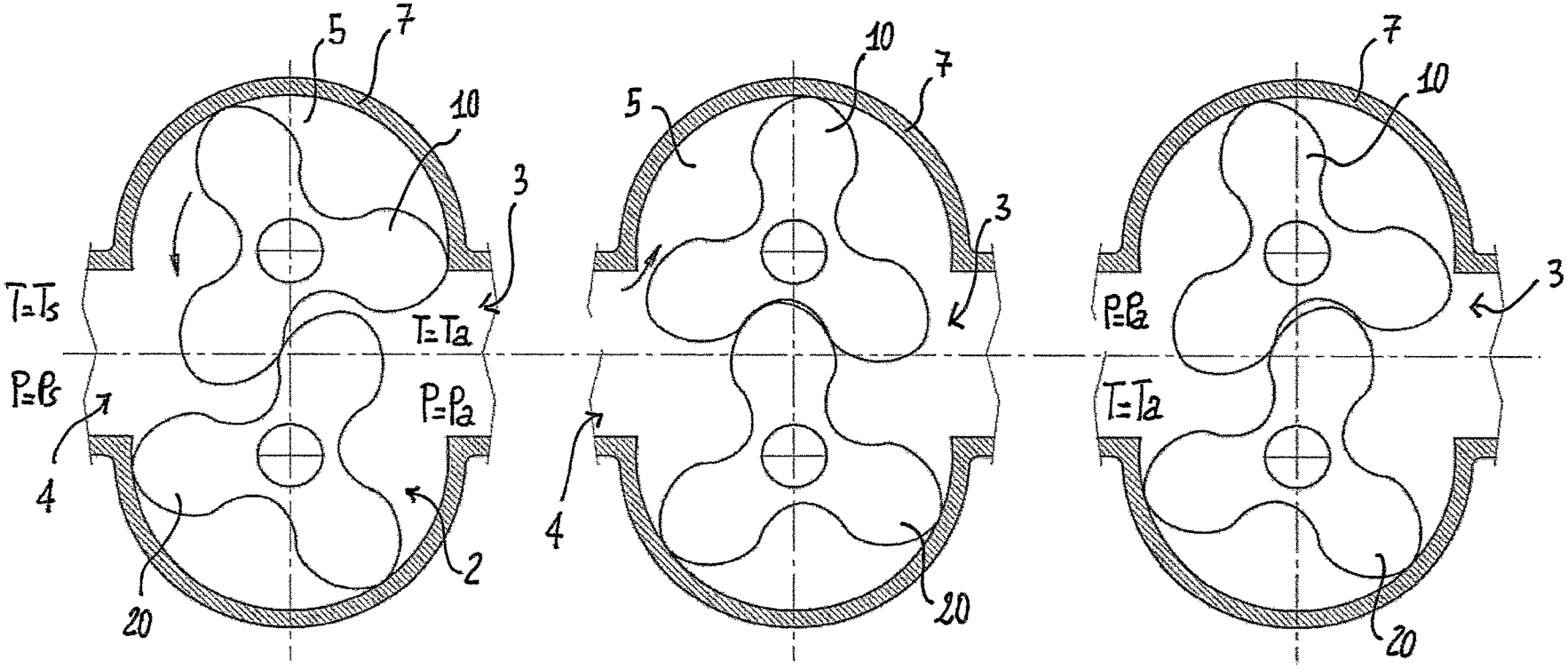
Figures 4, 5, 6:
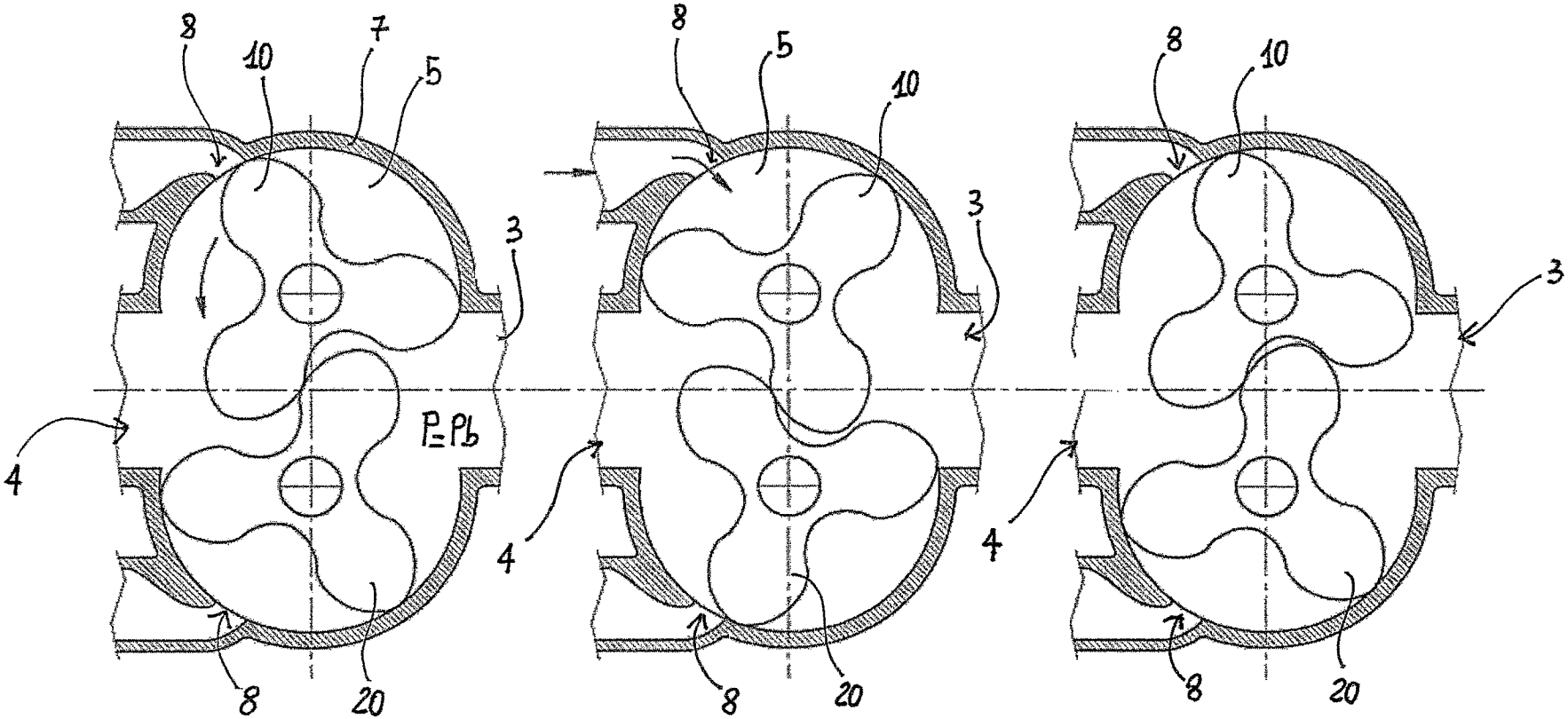
Figure 7:
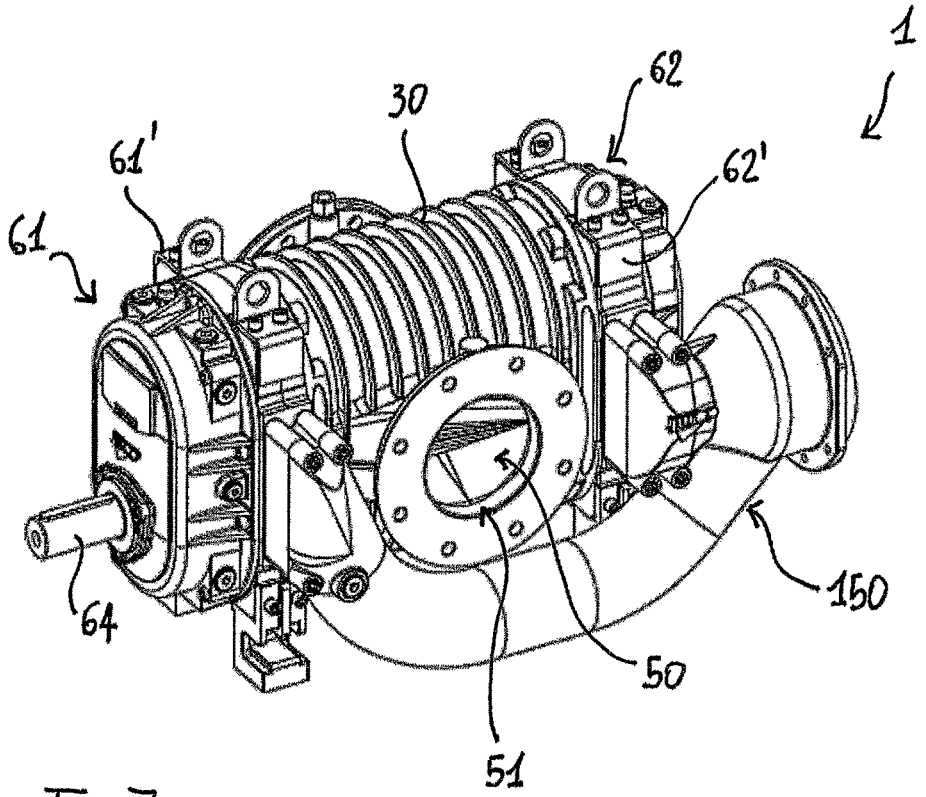
Figure 8:
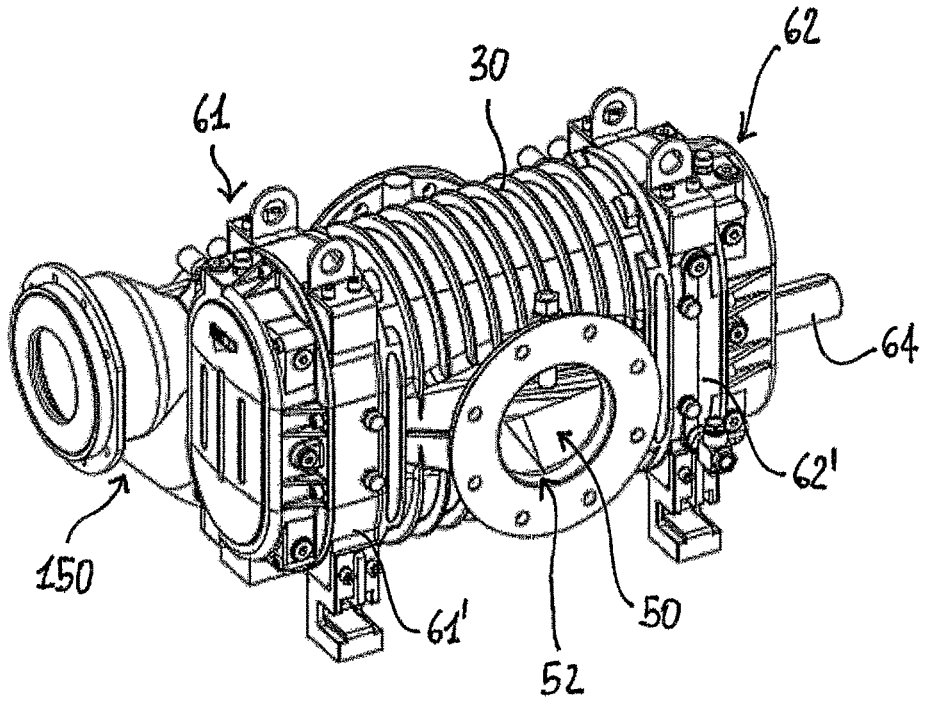
Figure 9:
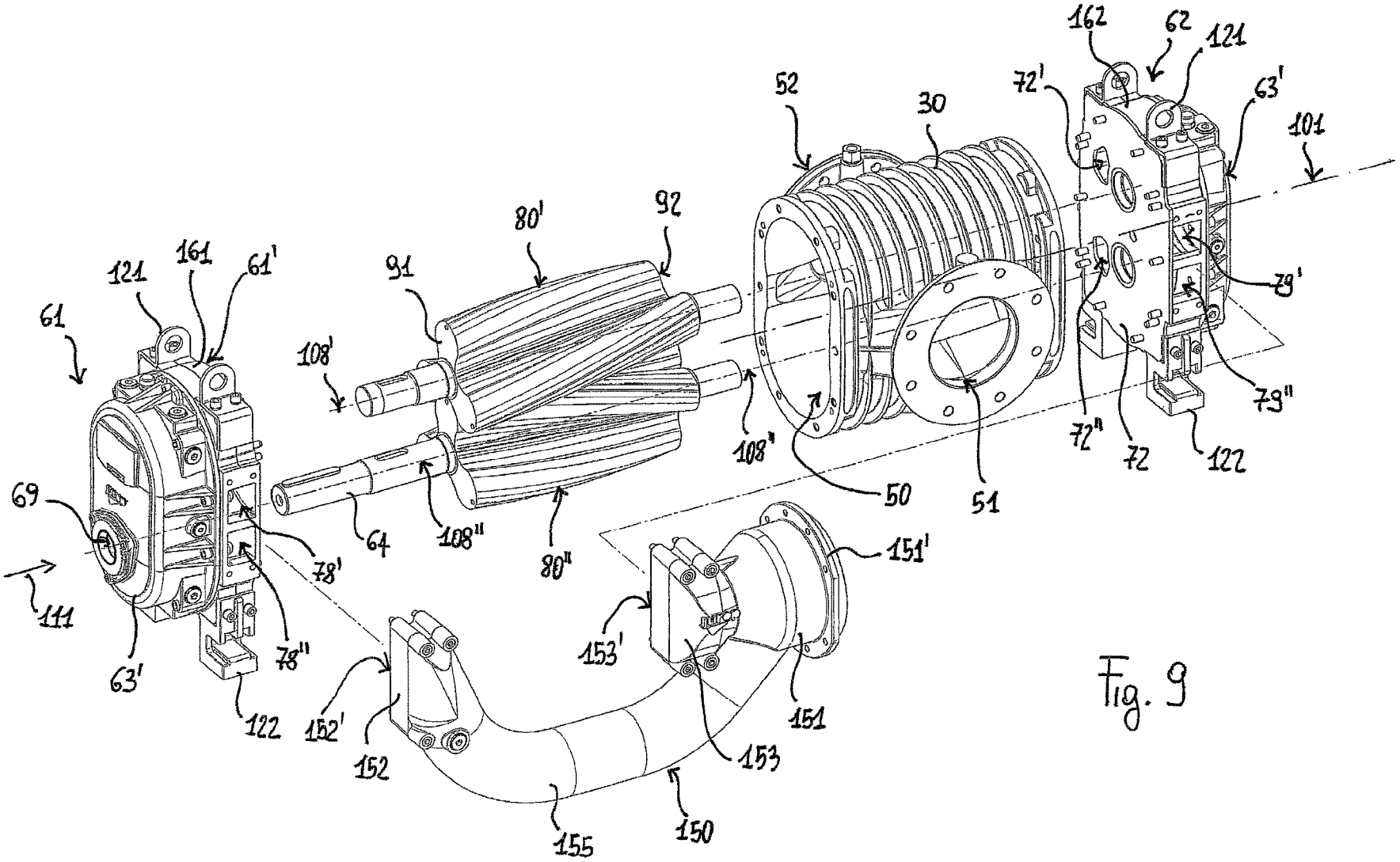
Figure 10:
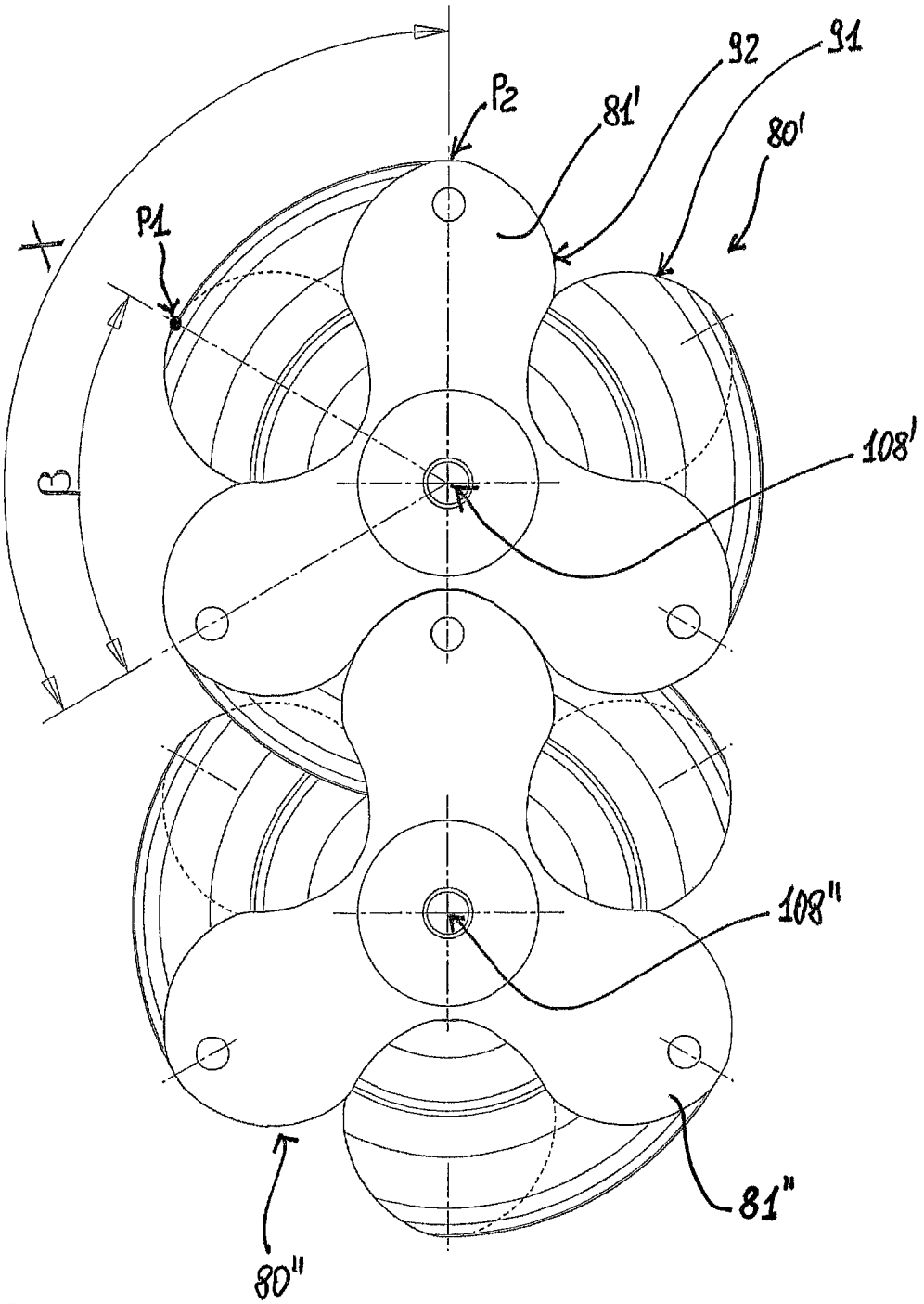
Figure 11:
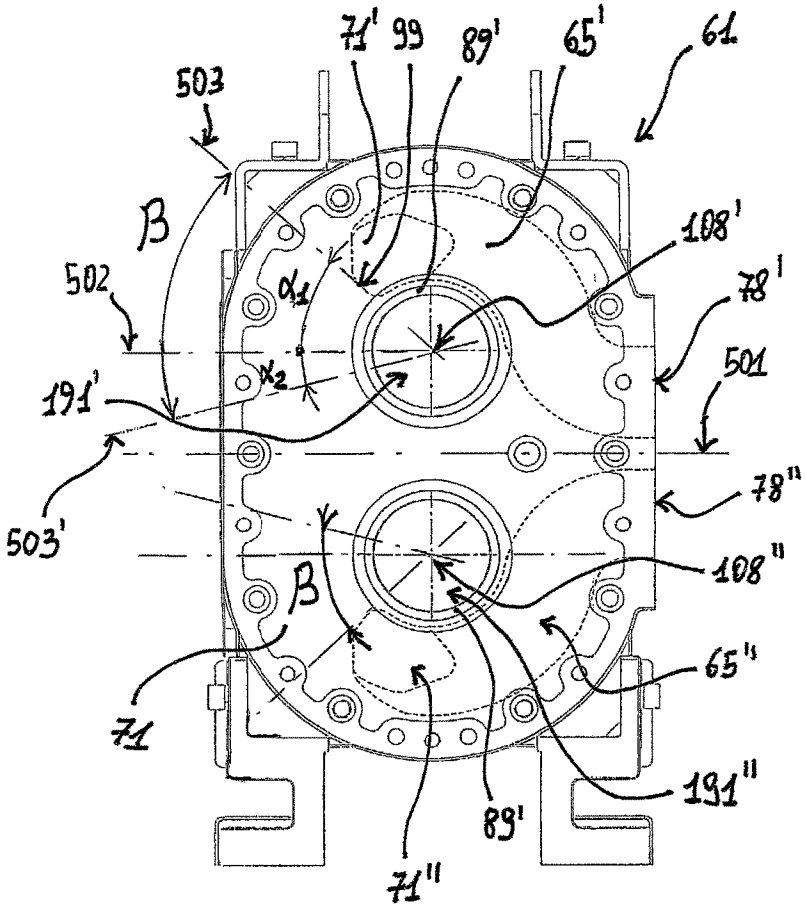
Figure 12:
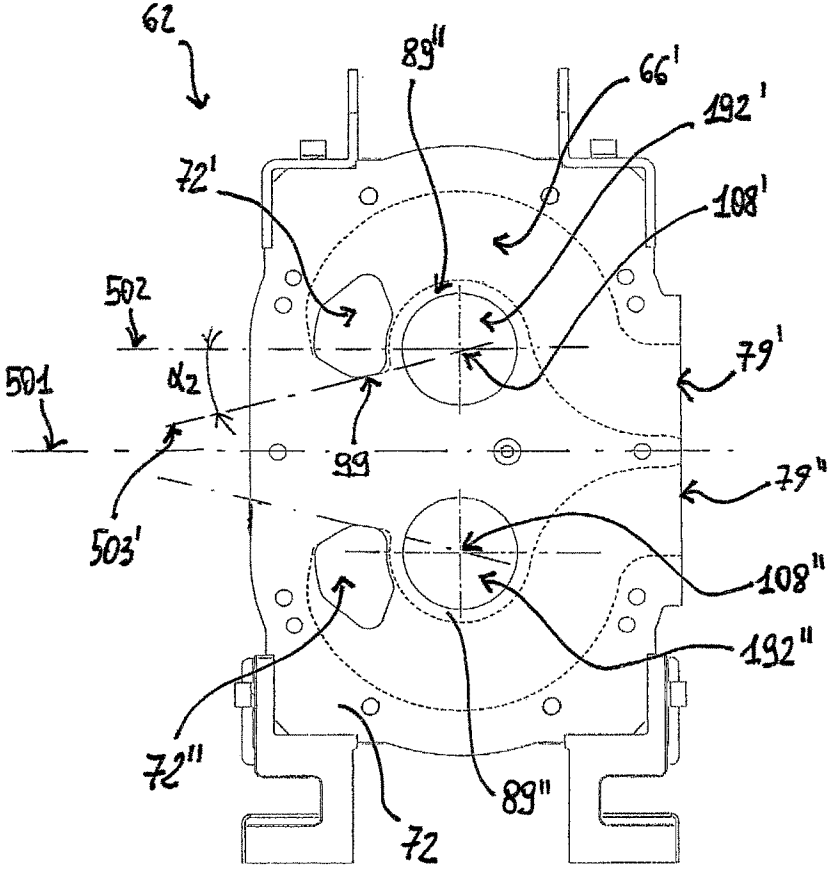
Figure 13:
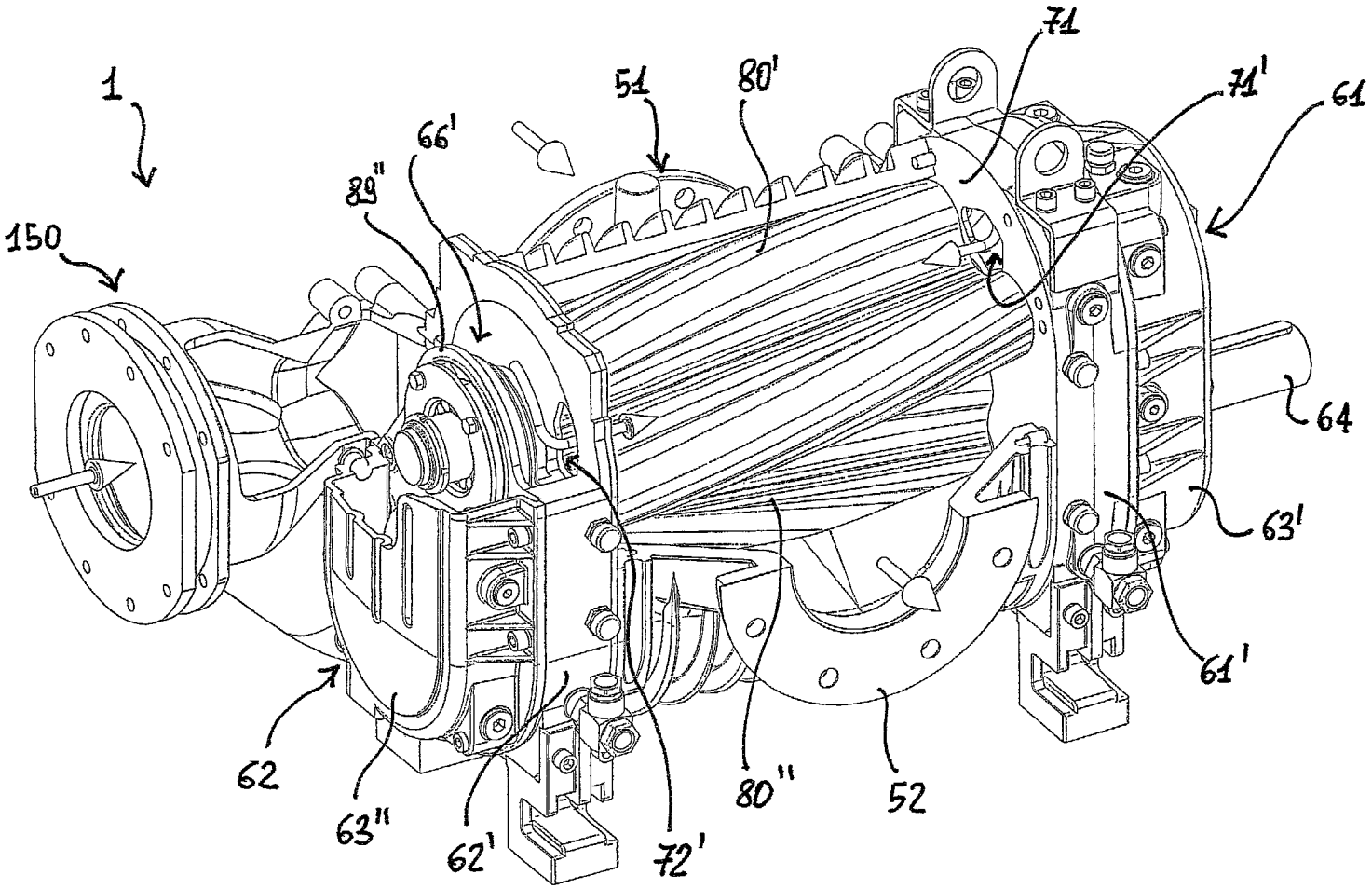
Figure 19:
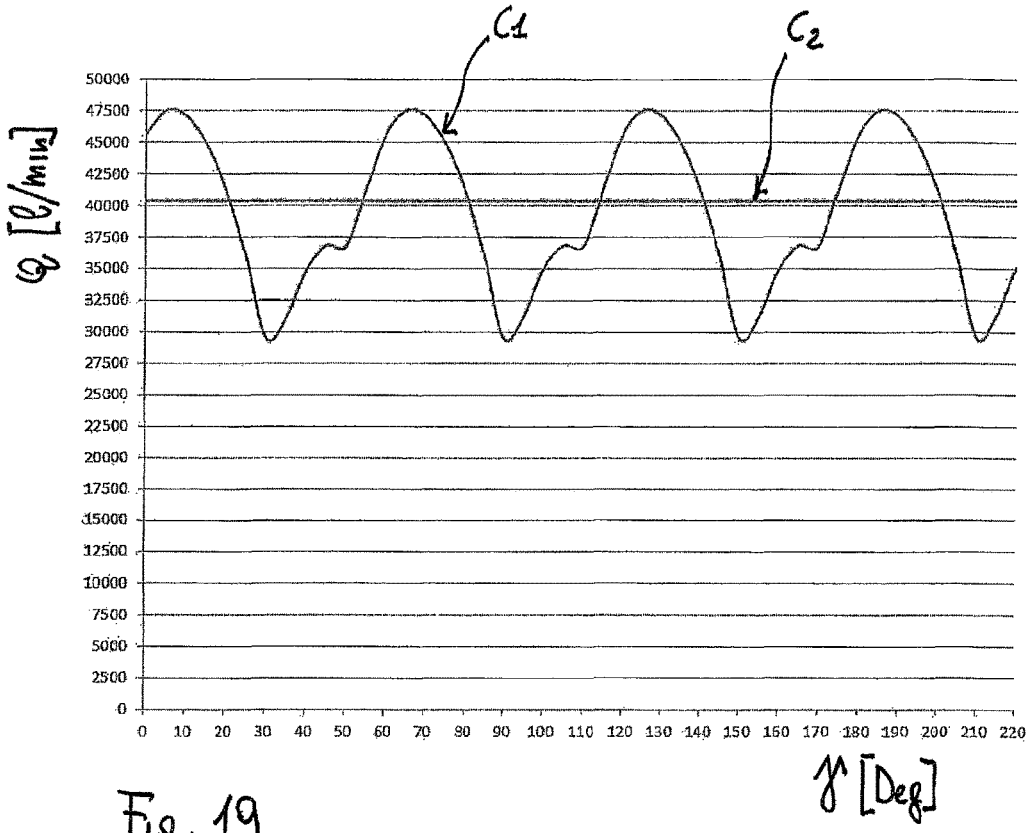
Figure 18:
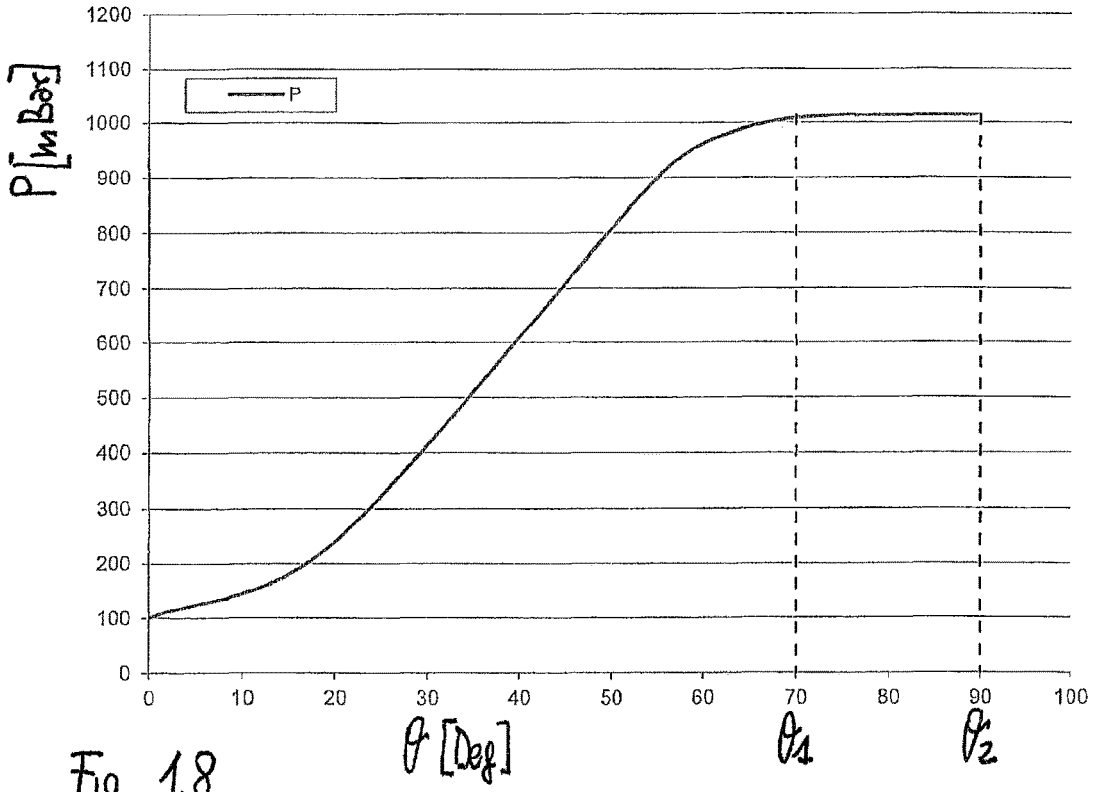

FIGS. from 4 to 6 are diagrammatic views related to the operation of a second compressor of known type;

FIGS. 7 and 8 are perspective views from different observation points of lobe compressor according to the present invention;

FIG. 9 is an exploded view of the compressor in FIGS. 7 and 8;

FIG. 10 is a view of two lobe rotors of the compressor in FIGS. 8 and 9;

FIGS. 11 and 12 are views of parts of the compressor in FIGS. 7 and 8;

FIG. 13 is a cutaway view of the compressor shown in FIGS. 7 and 8;

FIGS. from 14 to 17 are diagrammatic views related to the operation of a compressor according to the present invention;

FIGS. 18 and 19 are graphs related to the operation of a compressor according to the present invention.

DETAILED DESCRIPTION OF THE INVENTION

With reference to FIGS. from 7 to 17, the compressor 1 according to the present invention comprises an operative chamber 50 (hereinafter also indicated as "working chamber 50") defining a longitudinal development axis 101. Chamber 50 is defined by a main body 30, by a first header 61 and by a second header 62 connected on opposite sides to the body 30. In particular, the first header 61 and the second header 62 axially delimit the chamber 50, i.e. limit the chamber along the longitudinal axis 101.

In particular, body 30 also defines a suction section 51 and an exhaust section 52 of chamber 50. Suction section 51 and exhaust section 52 are configured for the suction and exhaust of a first fluid, respectively. Hereinafter, for the sake of simplicity of description, reference will be made to a first fluid in gas form. The expression "first gas" will also be used to indicate the first fluid.

As indicated above, the first header 61 and the second header 62 delimit the chamber 50 from opposite sides. The two headers 61,62 comprise a transversal surface 71,72, the word "transversal" indicating a surface which develops according to a plane substantially orthogonal to longitudinal axis 101. The distance between the transversal surface 71 of the first header 61 and the transversal surface 72 of the second header 62 substantially corresponds to the longitudinal extension of chamber 50 determined along longitudinal axis 101.

Compressor 1 comprises operative means for transferring the first fluid from suction section 51 to exhaust section 52. According to the invention, such operative means comprise at least one pair of rotors 80',80" with lobes 81',81". The two rotors 80',80" are housed in chamber 50 and are supported at their ends by headers 61,62 so as to each rotate about a corresponding rotation axis 108',108", which is substantially parallel to longitudinal axis 101. In the embodiment shown in the figures, rotors 80',80" comprise three lobes, but in alternative embodiments there could be a higher number of lobes 81',81".

Compressor 1 according to the invention is characterized in that the lobes 81',81" of the two rotors 80',80" develop according to a "helical" profile about the corresponding rotation axis 108',108". In other words, the lobes 81',81" of each rotor 80',80" develop between a first end section 91 and a second end section 92. More specifically, each of said end sections 91,92 is defined on a plane orthogonal to the corresponding rotation axis 108',108". The first section 91 and the second section 92 have the same conformation/shape, but a different angular position evaluated with respect to the corresponding rotation axis 108',108". In detail, the first section 91 is offset/rotated by an angle β (said offset angle) with respect to the second section 92 as indicated in FIG. 10. The latter shows the two rotors 80',80" isolated with respect to the rest of compressor 1. In FIG. 10, the profile of the second section 92 is partially dashed because the figure shows the first section 91 close-up. Again in FIG. 10, reference P1 indicates a vertex point of the first section 91 of a reference lobe 81'. Reference P2 indicates a vertex point according to the same section 92 corresponding to the same reference lobe 81'. As shown in FIG. 10, point P2 is rotated by an angle β with respect to P1. According to a preferred embodiment, the offset angle β is chosen as a function of the angle X between two lobes 81',81". In the case of three lobe rotors, angle X corresponds to 120° and offset angle β is of approximately 60°. In the case of a four lobe rotor 80',80", angle X will be of 90° and offset angle β will be of 45°. It is worth noting that the lobes 81',81" of each rotor 80',80" develop between a first end section 91 and a second end section 92.

According to the present invention, the first header 61 and the second header 62 each define at least one opening 71',71", 72',72" for injecting a second fluid in the chamber 50, e.g. in form of gas. Hereinafter, solely for the sake of ease of description, the expression "second gas" will be used to indicate said second fluid. In particular, for the first header 61, said at least one opening is defined through the transversal surface 71, while for the second header 62, said at least one opening is defined through said transversal surface 72.

The second gas is conveyed to headers 61,62 by means of a feeding device 150 communicating with an external source, preferably with ambient pressure and temperature conditions. Unlike the solutions known in the prior art and described above, in combination with the feeding device 150 of the second gas, the two headers 61,62 actually configure a "lateral injection", which is thus different from the "frontal injection" implemented in the traditional solutions. According to the invention, at least one "lateral injection" is thus provided at each of the headers 61,62.

As described in greater detail below, it has been seen that the lateral injection of the second gas leads to a considerable abatement of the noise of compressor 1, thus advantageously increasing the application possibilities thereof. More specifically, the lateral injection and the helical shape have a synergistic effect in terms of noise abatement. In addition to this, the lateral injection advantageously allows a direct cooling of the mechanical parts involved in the rotor rotation (gears, bearings etc.) which are housed in the headers 61,62 of compressor 1.

FIGS. 7 and 8 are perspective views of a compressor 1 according to the present invention, while FIG. 9 is an exploded view of the compressor itself. As shown, each of the headers 61,62 comprises at least one main portion 61',62'. As shown in FIG. 9, the transversal surface 72 of the second header 62 is connected to the main portion 62' of the second header 62. Substantially, the transversal surface 72 closes the main portion 62' on one side. Similarly, the transversal surface 71 of the first header 61 is connected to the main portion 61' of the first header 61 itself. Thus, the transversal surface 71 closes the main portion 61' on one side.

For each of headers 61,62, the corresponding main portion 61',62' is defined by a body 161,162 (indicated in FIG. 9) inside which supporting elements (e.g. bearings) are housed to support and allow the rotation of the two rotors 80',80".

According to another aspect of the present invention, each of the two headers 61, comprises at least one inner channel 65',65",66',66" which makes said feeding device 150 of the second gas communicating with said at least one injection opening 71',71",72',72" of the header itself. Substantially, such an inner channel 65',65",66',66" is crossed by the second gas coming from the feeding device 150 and intended for the chamber 50.

Preferably, said at least one inner channel 65',65",66',66" is defined between the body 161,162 of the corresponding header 61,62 and the corresponding transversal surface 71,72 connected to the body itself.

The first header 61 preferably comprises a closing element 63' connected to the body 161 of the main portion 61' on a side opposite to that to which the transversal surface 71 is connected. Closing element 63' defines a containing volume in which a motion transmission assembly (configured to connect the two rotors 80',80" to a motor external to compressor 1) is arranged.

Such a transmission assembly is configured to turn the two rotors 80', 80" synchronously, but in opposite directions. As shown in FIG. 9, closing element 63' defines an opening 69 for the passage of an end 64 of one of the two rotors 80',80" intended for connecting to an external motor (not shown).

According to a similar solution, the second header 62 preferably comprises a closing element 63" connected to the body 162 of the main portion 62' of the second header 62 itself on a side opposite to that to which the side surface 72 is connected. Also such a closing element 63" defines a containing volume in which the ends of rotors 80',80" and/or further mechanical elements functional to the rotation of the rotors themselves are arranged.

Again with reference to the exploded view in FIG. 9, for each of headers 61,62, coupling elements 121 for lifting and positioning compressor 1 and/or resting elements 122 defining a resting and connection plane of the compressor to equipment are connected to the corresponding body 161, 162. Coupling elements 121 and resting elements 122 are thus connected to the two headers 61,62 and not to the body 30 which defines chamber 50. In this manner, the structure of the body itself is simplified.

FIGS. 11 and 12 are front views of the two headers 61,62 separated from body 30 and from the other components of compressor 1. In particular, the two headers 61,62 are shown according to an observation point indicated by direction 111 indicated in FIG. 9. FIG. 11 shows a preferred embodiment of the first header 61 for which transversal surface 71 defines a first circular opening 191' coaxial with the rotation axis 108' of the first rotor 80' and a second circular opening 191" coaxial with the rotation axis 108" of the second rotor 80". The two circular openings 191',191" allow the positioning of the ends of rotors 80',80" in supports defined by the body 161 of the main portion 61' of the first header 61.

The transversal surface 71 of the first header 61 also defines two openings 71',71", for injecting the second gas, which are specular with respect to a reference plane 501, which is substantially parallel to the rotation axes 108', 108" of rotors 80',80" and equally distanced from the axes themselves. In detail, transversal surface 71 defines a first opening 71' for injecting the second gas in a volume of the working chamber 50 defined between the transversal surfaces 71,72, the two helical lobes 81',81" of the first rotor 80' and body 30. Similarly, through the second injection opening 71", the second gas is injected into a volume of chamber 50 defined between the transversal surfaces 71, 72, the two lobes 81', 81" of the second rotor 80" and the body 30.

Again with reference to FIG. 11, the body 161 of the main portion 61' of the first header 61 defines, preferably with transversal surface 71, a first inner channel 65', which develops between an inlet gap 78' of the second gas and the first injection opening 71'. Inlet gap 78' is defined on a part of main portion 61', which is preferably arranged on the same side as the suction section 51 defined by body 30. The body 161 of the main portion 61' of the first header 61 preferably also defines with transversal surface 71 a second inner channel 65', which develops between a second inlet gap 78' of the second gas and the second injection opening 71'. The second inlet gap 78" is defined on the same side of main portion 61' on which the first inlet gap 78' is defined. Preferably, the two inlet gaps 78',78" of the second gas are specular with respect to the reference plane 501 defined above.

In FIG. 11, the two channels 65',65" inside main portion 61' develop in specular manner with respect to the reference plane 501 defined above. As shown, each channel 65',65" comprises a circular sector shaped stretch, which develops about a supporting portion 89' of said main portion 61',62' which supports an end of a corresponding rotor 80,80'. Such a supporting portion 89' is defined by the body 161 of the first header 61. This particular conformation of channels 65',65" has been seen to advantageously promote the cooling of support portion 89' itself and of the ends themselves of rotors 80,80' with consequent advantages in terms of durability and reliability. At the same time, the gas flow through the two concerned channels 65',65" advantageously also promotes the cooling of the mechanical members housed in the corresponding closing element 63' of the first header 61.

FIG. 12 is a front view of the second header 62, the transversal surface 72 of which defines two circular openings 192',192", each of which is coaxial with the rotation axis 108',108" of a corresponding rotor 80',80". Similarly as envisaged for the first header 61, also the transversal surface 72 of the second header 62 further comprises a first injection opening 72' and a second injection opening 72" which are specular with respect to the aforesaid reference plane 501.

Again with reference to FIG. 12, the body 162 of the main portion 62' of the second header 62 defines, preferably with the second transversal surface 72, a first inner channel 66', which develops between a first inlet gap 79' of the second gas and the first inlet opening 72' defined by transversal surface 72. Such a first inlet gap 79' is defined on a part of main portion 62' which is preferably arranged on the side of suction section 51 defined by body 30. Body 162 itself, preferably with the second transversal surface 72, also defines a second inner channel 66", which develops between a second inlet gap 79" of the second gas and the second injection opening 72" of transversal surface 72. The second inlet gap 79" is defined on the same side of main portion 62" on which the first inlet gap 79' is defined. The two inlet gaps 79', 79" defined by the body 162 of the second header 62 are also preferably specular with respect to the reference plane 501 defined above.

With reference to the exploded view in FIG. 9, it is worth noting that the inlet gaps 78',78" of the second gas related to the main portion 61' of the first header 61 are defined, with respect to the body 30, on the same side on which the inlet gaps 79',79" of the same second gas relative to the main portion 62' of the second header 62 are defined.

Preferably, also the two channels 66',66" inside the main portion 62' of the second header 62 develop in specular manner with respect to the reference plane 501 defined above for the first header 61. Similarly as for the first header 61, each channel 66',66" of the second header 62 comprises a circular sector shaped stretch which develops about a supporting portion 89" of an end of a corresponding rotor 80,80'. Also in this case, the second fluid which crosses the channels 66',66" advantageously cools the supporting portion 89" and the mechanical parts adjacent thereto.

With this regard, the exploded view in FIG. 9 shows a first preferred embodiment of the feeding device 150 of the second gas which comprises an internally hollow body. The latter defines a manifold 151 configured to be connected, for example, through a flange 151', to a tank containing the second gas. The body of feeding device 150 also comprises a first portion 152 at which a first outlet 152' of the second gas in communication with manifold 151 is defined. The body of feeding device 150 itself also comprises a second portion 153 which defines a second outlet of the second gas also in communication with manifold 151.

The first portion 151 is connected to the part of the main portion 61' of the first header 61 in which the inlet openings 78',78" of inner channels 65',65" are defined inside the main portion 61" itself. In this manner, the first outlet 152' communicates with inlet openings 78',78". Similarly, the second portion 153 is connected to the part of the main portion 62' of the second header 62 in which the inlet openings 79',79" of inner channels 66',66" (in main portion 62" itself) are defined. In this manner, the second outlet 152' of the feeding device 150 communicates with the openings 79',79" and thus with the inner channels 66',66".

Again with reference to FIG. 9, it is worth noting that the first portion 152 is connected to manifold 151 by means of a connecting portion 155 which is a substantially arch-shaped. As shown in FIG. 7, when feeding device 150 is connected to the two headers 61,62, such a connecting portion 155 is arranged in position adjacent to the body 30 of compressor 1, but advantageously under suction section 51. In this manner, compressor 1 maintains an extremely compact configuration.

With reference again to FIGS. 11 and 12 already mentioned above, it is worth noting that the conformation of the first opening 71' defined by the transversal surface 71 of the first header 61 substantially coincides with that of the first opening 72' defined by the transversal surface 72 of the second header 62. Furthermore, it is worth noting that the angular position of the first opening 71' of the first header 61, evaluated with respect to the rotation axis 108' of the first rotor 80', is offset with respect to the angular position of the first opening 72' of the second header 62 by an angle corresponding to the offset angle β between the end sections 91,92 of the first rotor 80'. As shown in the cutaway view in FIG. 13, by means of this technical solution, during the rotation of the first rotor 80', the second gas is introduced through the openings 71' and 72" into a same volume of chamber 50 defined between the two transversal surfaces 71,72, the two lobes 81',81" of rotor 80',80" itself and the body 30.

The same reference stretch (indicated in FIGS. 11 and 12 by reference numeral 99) of the profile of such openings 71',72' must be considered in order to view the different angular position of the first opening 71' of the first header 61 with respect to the first opening 72' of the second header 62. In FIG. 11, reference $\alpha_1$ indicates the angle formed between a first reference plane 502, containing the rotation axis 108' of the first rotor 80' and parallel to reference plane 501, and a second reference plane 503 containing rotation axis 108' and tangent to the reference stretch 99 of the first opening 71' of the first header 61. Similarly, in FIG. 12, the angle indicated by reference $\alpha_2$ is defined between the first reference plane 502 and a second reference plane 503' containing rotation axis 108' and tangent to the same reference stretch of the profile of the first opening 72' of the second header 62. Such second angle $\alpha_2$ is also shown in FIG. 11 together with the second reference plane 503'. It is worth noting that the sum of angles $\alpha_1$ and $\alpha_2$ corresponds to offset angle 3.

Also for the second opening 71" of the first header 71, the angular position, evaluated with respect to the rotation axis 108" of the second rotor 80", is offset with respect to the angular position 72" of the second header 62 by an angle corresponding to offset angle β itself. Angle β between the two second openings 71",72" is also indicated in FIG. 11.

FIGS. from 14 to 17 are diagrammatic views of a compressor 1 according to the invention. In particular, such figures show two rotors 80',80" housed in chamber 50 and each having three lobes. The concerned figures show a section view of chamber 50 according to a section plane which is substantially orthogonal to the rotation axes 108', 108" of the two rotors 80',80". FIGS. from 14 to 17 show the transversal surface 71 of the first header 61 and also the two openings 71',71" defined through the surface itself. FIGS. from 14 to 17 also diagrammatically show two channels 65',65" through which the second gas reaches the two openings 71',71" and thus working chamber 50.

With reference to FIGS. from 14 to 17, in a "vacuum" operating condition, compressor 1 according to the invention works cyclically in three steps discussed below with reference, for the sake of convenience, to the first rotor 10 which rotates counterclockwise about rotation axis 108'. The considerations below also apply to the second rotor 80", which turns clockwise instead. Furthermore, the considerations shown below refer to a vacuum operation of compressor 1.

Figure 14:
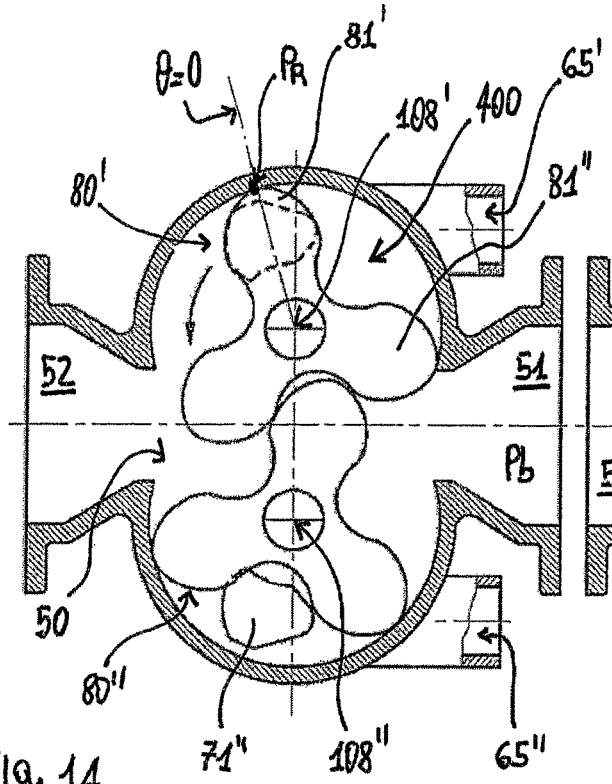

With reference to FIG. 14, during the synchronized rotation thereof, the two rotors 80',80" alternatively define the suction volumes, indicated by reference numeral 400, which are at a temperature (Ta) and at a pressure (Pb) corresponding to the conditions of the suction section 51. Specifically, each suction volume 400 is defined by a body 30 which defines chamber 50, by transversal surfaces 71,72 of the two headers 61,62 and by two reference lobes 81',81" of a corresponding rotor 80',80". Point Pr indicated in FIGS. from 14 to 17 indicate the vertex of a first reference lobe 81' which reaches first the gap defined by exhaust section 52.

Figure 15:
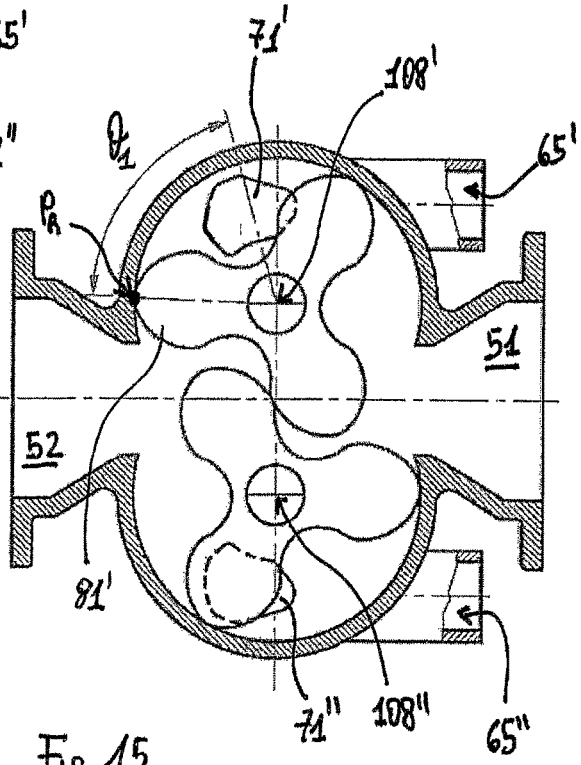
Figure 16:
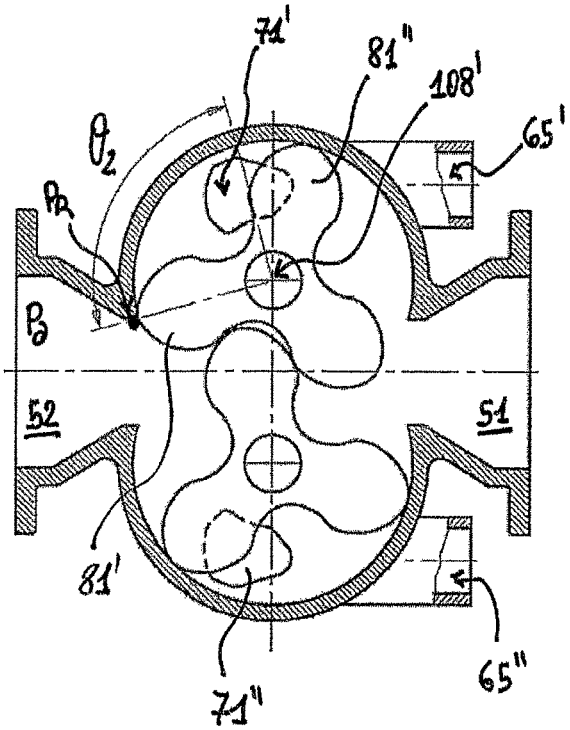
Figure 17:
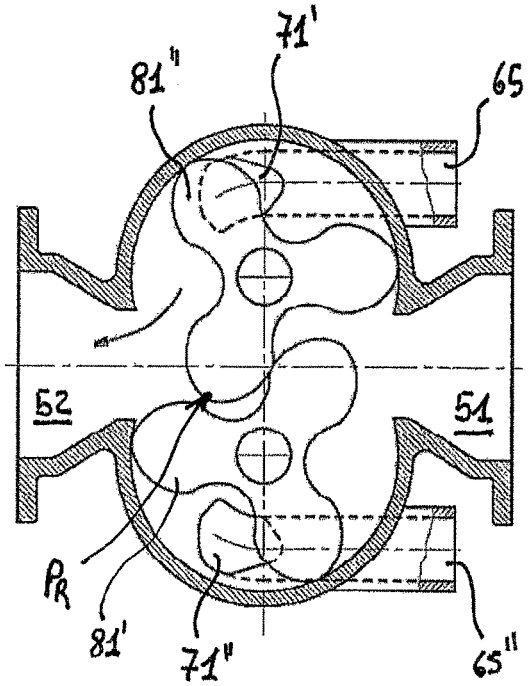

Specifically, FIG. 14 shows an operative instant in which the aforesaid suction volume 400 is defined. In such an instant, the movement of the first rotor 80' determines the opening of the first injection opening 71' of the first header 61 and of the first injection opening 72' of the second header 62. The second gas enters into reference volume 400 at ambient pressure Pa and at ambient temperature Ta through such openings 71',72'. The second gas expands in the reference volume, because the Pb<Pa ratio applies, and compresses the first gas already present to reach pressure Pa. FIG. 15 shows the step of injecting of the second gas through the two openings 71',72', while FIG. 16 shows the incipient instant of the start of the step of exhausting. It is worth noting that in such an instant, point Pr is arranged substantially at an edge defined between the operative chamber and exhaust section 52. It is worth noting that the pressure in the reference number 400 of chamber 50 reaches ambient pressure Pa before the opening of the exhaust gap, i.e. before the condition in FIG. 15. In this manner, the step of exhausting, shown in FIG. 17, is always at constant pressure.

With respect to the frontal injection which is characteristic of the known technical solutions, the lateral injection of injection gas through the two headers 61,62 makes it possible to obtain a significant containment/reduction of the pulsation in the exhaust pipes and at the same time to abate the flow rate oscillations in exhaust. Indeed, the filling of the reference volume 400 of chamber 50 occurs gradually during the rotation of the motor, as shown in the graph in FIG. 18. In particular, FIG. 18 shows a curve related to the filling of the chamber 50 by effect of the lateral injection in maximum vacuum conditions (95%) and a nominal rotation speed of the rotors. The diagram in FIG. 18 shows the pressure P [mBar] reached in reference volume 400 on the ordinate and the opening angle ϑ [deg] of the injection meaning the angular difference between a reference angular position, corresponding to an incipient injection condition, and the real angular position on the abscissa. With this regard, FIG. 14 indeed shows the incipient injection condition in which the opening angle ϑ is zero (ϑ=0°), while FIGS. 15 and 16 show different opening angles ($\vartheta=\vartheta_1$, $\vartheta=\vartheta_2$). FIG. 18 shows that the injection of the second gas is distributed on an arc of significant degrees, of approximately 70°, thus being advantageously "gradual" contrarily to the frontal type injection which constitutes, in actual fact, a nearly instantaneous phenomenon, i.e. reduced to a few degrees of rotation of the rotor, which represents a source of noise.

Again in FIG. 18, it is worth noting that the maximum pressure (Pa) is reached at a value 81 (condition in FIG. 15), which is smaller than an angle $\vartheta_2$ (condition in FIG. 16) characteristic of an incipient exhaust condition. This means that the exhaust through exhaust section 52 always occurs at a constant pressure value Pa. Consequently, the step of exhausting (FIG. 17) occurs without sudden pressure balancing typical instead of traditional type compressors without injection or with frontal injection. Ultimately, an abatement of the noise in exhaust is obtained.

In addition to this, it has been seen that the lateral injection in combination with the helical development of the lobes of the rotors makes it possible to obtain a flow rate in exhaust which is advantageously constant as can be observed from the diagram in FIG. 19. In detail, such a diagram shows a first pressure curve, indicated by reference C1, which indicates the trend of the flow rate Q [l/min] in exhaust as a function of the rotation angle ϒ [Deg] of rotors 80',80" in the case of a traditional type compressor with straight lobes and frontal type injection. Curve C2 instead indicates the trend of the flow rate as a function of the rotation angle r of the rotors 80',80" in the case of a compressor 1 according to the invention, i.e. with lateral injection and helical development lobes. The abatement of the flow rate oscillations which can be obtained by means of the technical solutions described above is apparent by comparing the two curves C1 and C2.

The compressor according to the present invention achieves the predetermined tasks and objects. In particular, with respect to the known solutions, the lateral injection in combination with the helical development of the lobes of the rotors makes it possible to obtain an advantageous noise abatement, as confirmed by the data obtained in tables 1 and 2 shown below. In particular, three different compressors at constant revolutions per minute [rpm], and thus constant processed flow rate, were compared. Indeed, the three compared compressors have the same displacement. The first examined compressor (third column in tables 1 and 2) is of traditional type with injection on the body and straight lobe rotors. The second examined compressor (fourth column from the left in tables) has a lateral injection according to the principles of the present invention with straight lobe rotors.

Table 1 refers to a "vacuum" operation of the three examined compressors with a vacuum percentage [Vac] equal to 80 (i.e. with a relative pressure in suction of about 202 mBar). Table 2 refers instead to an operation with no vacuum and with pressure equal to zero. Injection is not activated in such conditions.

Tables 1 and 2 show the sound power (LwA) expressed in decibel [dB] detected as the rotation speed varies for each of the examined compressors. Such a sound power represents the noise index of the compressor determined by the movement of the mechanical parts, of the pulsations in the injection pipes and/or the pressure variations which are generated in exhaust.

Table 1 shows that the compressor according to the invention (lateral injection and helical lobe rotors) allows a noise reduction of at least 16% in terms of decibels [dB] at 2300 revolutions per minute [rpm] and of even 21% at 3100 revolutions per minute [rpm] with respect to a traditional type compressor (injection on the body and straight lobe rotors).

TABLE 1

| Rev per min [rpm] | Vac [%] | Injection on body LwA [dB] Straight lobes | Lateral injection LwA [dB] Straight lobes | Lateral injection LwA [dB] Helical lobes |
|---|---|---|---|---|
| 2300 | 80 | 107 | 94 | 89 |
| 2500 | 80 | 112 | 92 | 90 |
| 2700 | 80 | 117 | 97 | 95 |
| 3100 | 80 | 122 | 98 | 96 |

TABLE 2

| Rev per min [rpm] | Vac [%] | Injection on body LwA [dB] Straight lobes | Lateral injection LwA [dB] Straight lobes | Lateral injection LwA [dB] Helical lobes |
|---|---|---|---|---|
| 2300 | 0 | 90 | 90 | 86 |
| 2500 | 0 | 92 | 92 | 88 |
| 2700 | 0 | 96 | 96 | 91 |
| 3100 | 0 | 98 | 98 | 93 |

Again with reference to Table 1, by comparing the data related to the second compressor (lateral injection and straight lobes) and those related to the compressor according to the invention, the synergistic effect in terms of noise abatement deriving from the combined use of the lateral injection and of the helical rotors is apparent.

In Table 2 it can be noted that in absence of injection (operation under pressure, even if zero) the use of the helical lobe rotors however makes it possible to reduce noise by approximately 4.4% for a rotation rate of 2300 [rpm] and of about 5.1% for a rotation rate of about 3100 [rpm] with respect to a straight lobe rotor compressor.

From the above, the combination of the technical solutions indicated above makes it possible to obtain an expansion of the range of use of the compressor both in terms of achievable vacuum percentage and in terms of optimal operating speed, top speed, and consequently maximum flow rate. The compressor according to the invention thus makes it possible to reduce noise and vibrations, which translates into a corresponding reduction of acoustic pollution and a greater durability of the mechanical components.

The invention claimed is:

1. A volumetric compressor for material collection and/or treatment equipment, said volumetric compressor comprising:

an operative chamber defining a longitudinal development axis, a main body which defines said chamber, said body defining a suction section and an exhaust section of a first fluid;

a first header and a second header connected on opposite sides of said main body, said headers delimiting said chamber on opposite sides along said longitudinal axis;

at least two rotors with lobes housed in said chamber and supported at opposite ends by said headers; each of said rotors rotating about a rotation axis substantially parallel to said longitudinal axis;

a feeding device of a second fluid, wherein, for each of said rotors, said lobes have a "helical" development, and each of said two headers defines at least one injection opening communicating with said feeding device, each of said injection openings being configured to inject said second fluid coming from said feeding device into said chamber.

2. The volumetric compressor according to claim 1, wherein for each of said rotors, said lobes develop between a first end section and a second end section having an angular position, determined with respect to the corresponding rotation axis, reciprocally offset by a predetermined angle (β).

3. The volumetric compressor according to claim 2, wherein said at least one injection opening defined by said first header and said at least one injection opening defined by said second header have an angular position, determined with respect to the rotation axis of a corresponding rotor, reciprocally offset by an angle corresponding to said predetermined angle (β).

4. The volumetric compressor according to claim 1, wherein each of said headers comprises a main portion which defines an inner passage which develops between said at least one injection opening and an outlet of said feeding device.

5. The volumetric compressor according to claim 1, wherein the at least one injection opening defined by each of said headers comprises a first injection opening and a second injection opening, and wherein for each of said headers said first injection opening is substantially specular to said second injection opening with respect to a reference plane parallel to and equally distanced from said rotation axes of said rotors.

6. The volumetric compressor according to claim 5, wherein each of said headers defines a first inner passage which develops between said first injection opening and a first outlet of said feeding device and a second inner passage which develops between said second injection opening and a second outlet of said feeding device.

7. The volumetric compressor according to claim 6, wherein for each of said headers, said first inner passage has a configuration which is specular to that of said second inner passage with respect to said reference plane.

8. The volumetric compressor according to claim 6, wherein for at least one of said headers:

said first inner passage develops between said first injection opening and a first inlet gap of said second fluid; and said second inner passage develops between said second injection opening and a second inlet gap of said second fluid;

wherein said inlet gaps are defined on one same side of said main portion.

9. The volumetric compressor according to claim 6, wherein for at least one of said headers, each of said inner passages comprises a circular sector shaped stretch which develops about a supporting portion of said main portion, which supports an end of a corresponding rotor from among said at least two rotors.

10. The volumetric compressor according to claim 5, wherein each of said headers comprises:

a main portion;

a transversal surface connected to said main portion, said transversal surface defining said first injection opening and said second injection opening, and wherein for each of said headers, said first inner passage and said second inner passage are defined between said transversal surface and said main portion.

11. The volumetric compressor according to claim 10, wherein at least one of said headers comprises a closing element connected to the corresponding main portion on a side opposite to that to which the corresponding transversal surface is connected, said closing element defining a containing volume for housing an end of said rotors and/or further mechanical members functional to the rotation of the rotors themselves.

12. Equipment for suction and/or treatment of material in liquid, solid, dusty or muddy form, characterized in that it comprises the volumetric compressor according to claim 1.

13. The volumetric compressor according to claim 1, wherein each of said headers comprises a main portion which defines an inner passage which develops between said at least one injection opening and an outlet of said feeding device.

14. The volumetric compressor according to claim 1, wherein the at least one injection opening defined by each of said headers comprises a first injection opening and a second injection opening, and wherein for each of said headers said first injection opening is substantially specular to said second injection opening with respect to a reference plane parallel to and equally distanced from said rotation axes of said rotors.

15. The volumetric compressor according to claim 14, wherein each of said headers defines a first inner passage which develops between said first injection opening and a first outlet of said feeding device and a second inner passage which develops between said second injection opening and a second outlet of said feeding device.

16. The volumetric compressor according to claim 15, wherein for each of said headers, said first inner passage has a configuration which is specular to that of said second inner passage with respect to said reference plane.

17. The volumetric compressor according to claim 15, wherein for at least one of said headers:

said first inner passage develops between said first injection opening and a first inlet gap of said second fluid; and said second inner passage develops between said second injection opening and a second inlet gap of said second fluid;

wherein said inlet gaps are defined on one same side of said main portion.

18. The volumetric compressor according to claim 14, wherein each of said headers comprises:

a main portion;

a transversal surface connected to said main portion, said transversal surface defining said first injection opening and said second injection opening, and wherein for each of said headers, said first inner passage and said second inner passage are defined between said transversal surface and said main portion.

19. The volumetric compressor according to claim 18, wherein at least one of said headers comprises a closing element connected to the corresponding main portion on a side opposite to that to which the corresponding transversal surface is connected, said closing element defining a containing volume for housing an end of said rotors and/or further mechanical members functional to the rotation of the rotors themselves.

20. A volumetric compressor for material collection and/or treatment equipment, said volumetric compressor comprising:

an operative chamber defining a longitudinal development axis, a main body which defines said chamber, said body defining a suction section and an exhaust section of a first fluid;

a first header and a second header connected on opposite sides of said main body, said headers delimiting said chamber on opposite sides along said longitudinal axis;

at least two rotors with lobes housed in said chamber and supported at opposite ends by said headers; each of said rotors rotating about a rotation axis substantially parallel to said longitudinal axis;

a feeding device of a second fluid, wherein, for each of said rotors, said lobes have a "helical" development, and each of said two headers defines at least one injection opening communicating with said feeding device, each of said injection openings being configured to inject said second fluid coming from said feeding device into said chamber, wherein said at least one injection opening defined by said first header and said at least one injection opening defined by said second header have an angular position, determined with respect to the rotation axis of a corresponding rotor, reciprocally offset by an angle corresponding to a predetermined angle ($\beta$).

* * * * *